US009630328B2

(12) United States Patent
Koenig et al.

(10) Patent No.: US 9,630,328 B2
(45) Date of Patent: Apr. 25, 2017

(54) FOLDING TOOL ADAPTED FOR SIMPLE ASSEMBLY AND DISASSEMBLY

(71) Applicants: Bill Koenig, Meridian, ID (US); Theodore Jacob Schwarz, Salmon, ID (US)

(72) Inventors: Bill Koenig, Meridian, ID (US); Theodore Jacob Schwarz, Salmon, ID (US)

(73) Assignee: Benchmade Knife Co., Inc., Oregon City, OR (US)

( * ) Notice: Subject to any disclaimer, the term of this patent is extended or adjusted under 35 U.S.C. 154(b) by 0 days.

(21) Appl. No.: 14/750,281

(22) Filed: Jun. 25, 2015

(65) Prior Publication Data

US 2016/0031096 A1 Feb. 4, 2016

Related U.S. Application Data

(60) Provisional application No. 62/017,005, filed on Jun. 25, 2014.

(51) Int. Cl.

| | |
|---|---|
| ***B26B 1/02*** | (2006.01) |
| ***B26B 1/10*** | (2006.01) |
| ***B26B 5/00*** | (2006.01) |
| ***B26B 1/04*** | (2006.01) |

(52) U.S. Cl.

CPC ..... *B26B 1/02* (2013.01); *B26B 1/044* (2013.01); *B26B 1/10* (2013.01); *B26B 5/00* (2013.01)

(58) Field of Classification Search

CPC .... B26B 1/02; B26B 5/00; B26B 1/10; B26B 11/003; B26B 1/044

USPC ..... 30/153

See application file for complete search history.

(56) References Cited

U.S. PATENT DOCUMENTS

| | | | | | |
|---|---|---|---|---|---|
| 576,648 | A * | 2/1897 | Autenrieth | B26B 29/025 | 30/151 |
| 1,087,342 | A * | 2/1914 | Yerzley | B26B 1/04 | 30/157 |
| 5,647,132 | A * | 7/1997 | Berns | B26B 5/00 | 30/125 |
| 5,797,188 | A * | 8/1998 | Gilbert | B26B 5/00 | 30/330 |
| 6,101,723 | A * | 8/2000 | Ford | B26B 1/044 | 30/157 |
| 6,134,788 | A * | 10/2000 | Chen | B26B 1/046 | 30/125 |
| 6,446,341 | B1 * | 9/2002 | Wang | B26B 1/046 | 30/123 |
| 7,370,421 | B2 * | 5/2008 | Onion | B26B 1/044 | 30/157 |
| 7,716,839 | B2 * | 5/2010 | Onion | B26B 1/044 | 30/156 |

(Continued)

*Primary Examiner* — Hwei C Payer
(74) *Attorney, Agent, or Firm* — Hancock Hughey LLP

(57) ABSTRACT

A folding tool such as a knife includes first and second spaced apart sidewalls with a blade pivotally attached to both sidewalls with a self-interlocking pivot pin. An opening in one sidewall includes a first, larger portion that receives an end of the pivot pin, and a smaller cylindrical opening that communicates with the larger portion through a slot. The end of the pivot pin slides through the slot and the sidewalls are rotated relative to one another to interlock the sidewalls. The knife may be easily assembled and disassembled without tools.

3 Claims, 6 Drawing Sheets

(56) References Cited

U.S. PATENT DOCUMENTS

| | | | | |
|---|---|---|---|---|
| 2014/0245616 | A1* | 9/2014 | Onion | B26B 1/04 30/161 |
| 2016/0031096 | A1* | 2/2016 | Koenig | B26B 1/02 30/161 |

* cited by examiner

FOLDING TOOL ADAPTED FOR SIMPLE ASSEMBLY AND DISASSEMBLY

This invention claims the benefit of U.S. Provisional Patent application No. 62/017,005, filed Jun. 25, 2014, the entirety of which is incorporated herein by this reference.

FIELD OF THE INVENTION

This invention relates to tools that have implements foldably attached to a handle, for example, a folding knife or folding multi-tool in which the handle and blade(s) and/or implements may be easily assembled and disassembled without use of conventional screws and other fasteners that require separate tools.

BACKGROUND

Conventional folding knives are ubiquitous and essential tools that have been used for many, many years and which are used for countless purposes. Folding knives come in hundreds of different configurations, but broadly generalized, have handles that are defined by opposed sidewalls or handle halves that are attached together with a space between the opposed sidewalls for receiving the blade when the blade is in the closed position—the blade receiving groove is located in the space between the sidewalls. The blade is rotatably attached to the two handle halves with a pivot shaft that extends through a tang portion of the blade. As the blade rotates between closed and open, open and closed, the blade rotates about the pivot shaft. A variety of spacers and screws are used to attach the handle halves together. Folding knives are usually assembled by the manufacturer—the parts are interconnected with tools that fit the screws and other fasteners.

Folding knives often require disassembly in order to clean the parts or to repair damaged parts. But with most folding knives, disassembly requires tools that fit the various screws and the like that connect all of the parts. This can be difficult enough in a shop environment where proper tools are on hand. But disassembly may be required in the field where the work is much more difficult even where tools are available. And given that some folding knives can incorporate rather complicated internal structural features, disassembly can be a difficult task and reassembly even more so.

In addition, in some instances a user will want to replace one component with a different component that has a different purpose. One example would be replacing a drop point blade with a skinning blade. Another example is replacing a completely worn blade with a fresh, sharp blade. These tasks can be difficult to accomplish with proper tools in any setting.

Furthermore, knife enthusiasts often find that the fasteners that are conventionally used to interconnect the handle halves are unattractive and detract from the overall aesthetic of the tool.

There is a need therefore for a folding knife that is configured to make assembly and disassembly of the knife components relatively easier. The present invention defines such a knife. The knife components may be completely assembled and disassembled without tools and the knife components are stably interconnected without conventional screws and similar fasteners that require tools to manipulate.

BRIEF DESCRIPTION OF THE DRAWINGS

The invention will be better understood and its numerous objects and advantages will be apparent by reference to the following detailed description of the invention when taken in conjunction with the following drawings in which:

FIG. 3 is a perspective view of the knife shown in FIG. 1 in which the first sidewall of the handle has been rotated relative to the second sidewall to begin the disassembly process.

FIG. 4 is a side elevation view of the knife shown in FIG. 3 in which the first sidewall has been rotated to a greater degree, continuing the disassembly process.

FIG. 5 is the next sequential step showing the disassembly process of the knife of FIG. 3, and in which the first sidewall is being disengaged from the pivot pin.

FIG. 6 is a perspective and exploded view of the knife shown in FIG. 3 in which the component parts have been completely separated from one another.

FIG. 9 is a perspective view of the second illustrated embodiment of a folding knife according to the invention in which the blade is in the open position.

FIG. 10 is a perspective view of the knife shown in FIG. 9 and in which the near-side sidewall of the handle has been rotated relative to the far-side sidewall.

FIG. 11 is a perspective view and partly fragmentary of the knife of FIG. 9 in which the components of the knife are laid out adjacent to one another in a view similar to an exploded view and in which the interior surfaces of the two sidewalls that comprise the knife handle are illustrated.

FIG. 12 is a perspective view of the interior surface of the butt end of one sidewall of the knife shown in FIG. 9.

DETAILED DESCRIPTION OF THE PREFERRED EMBODIMENTS

Figure 1:
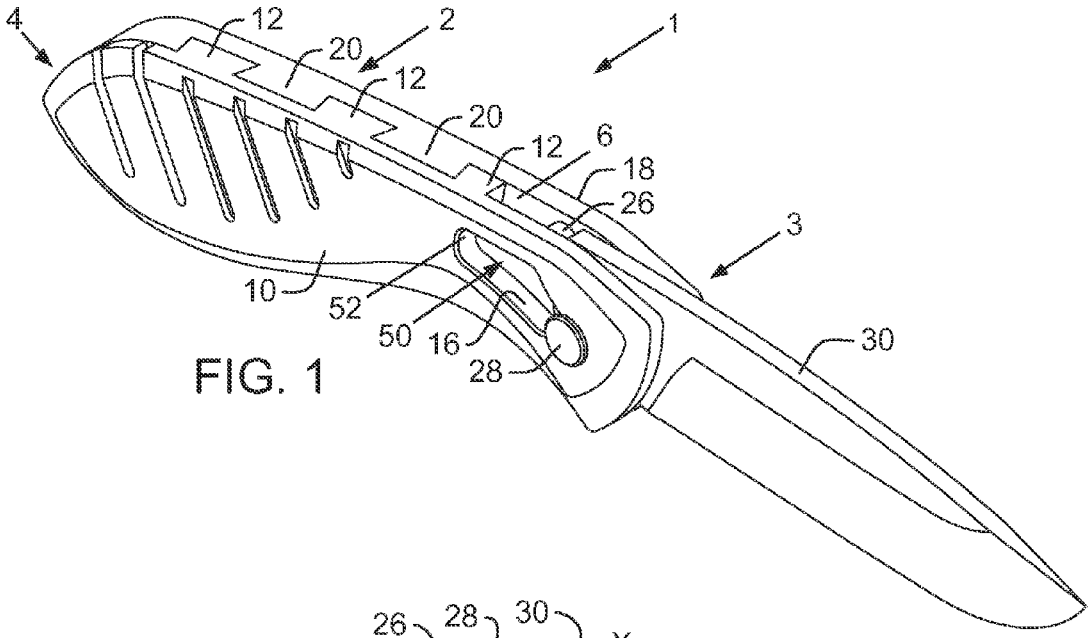
FIG. 1 is a perspective view of a first illustrated embodiment of a folding knife according to the present invention, in which the blade is in the open position.

A first illustrated embodiment of a folding knife 1 according to the present invention is illustrated in FIGS. 1 through 8. Generally, folding knife 1 is defined by an elongate handle 2 and a blade 30 that is pivotally attached to the handle at the "forward" end 3 of handle 2. The opposite end of handle 2 is referred to as rearward or butt end 4. Other relative directional terms used in this description correspond to this convention: the "rear" or butt end of the handle is opposite the forward end; the "upper" part of the blade is the dull, non-working portion and the "lower" part of the blade is the sharpened, working portion; "inner" or "inward" refers to the structural center of the knife, and so on.

Handle 2 is defined by a first sidewall 10 and a second sidewall 18. In the assembled knife 1 (FIG. 1), the first and second sidewalls 10 and 18 are held in a spaced apart relationship to define a blade-receiving groove 6 between the sidewalls. The blade 30 is retained between the sidewalls with a pivot pin 28 (as detailed below) and is pivotally movable between the open position shown in FIG. 1 and a closed position (not shown) in which the sharpened portion of the blade is stowed safely in the blade-receiving groove 6.

Figure 6:
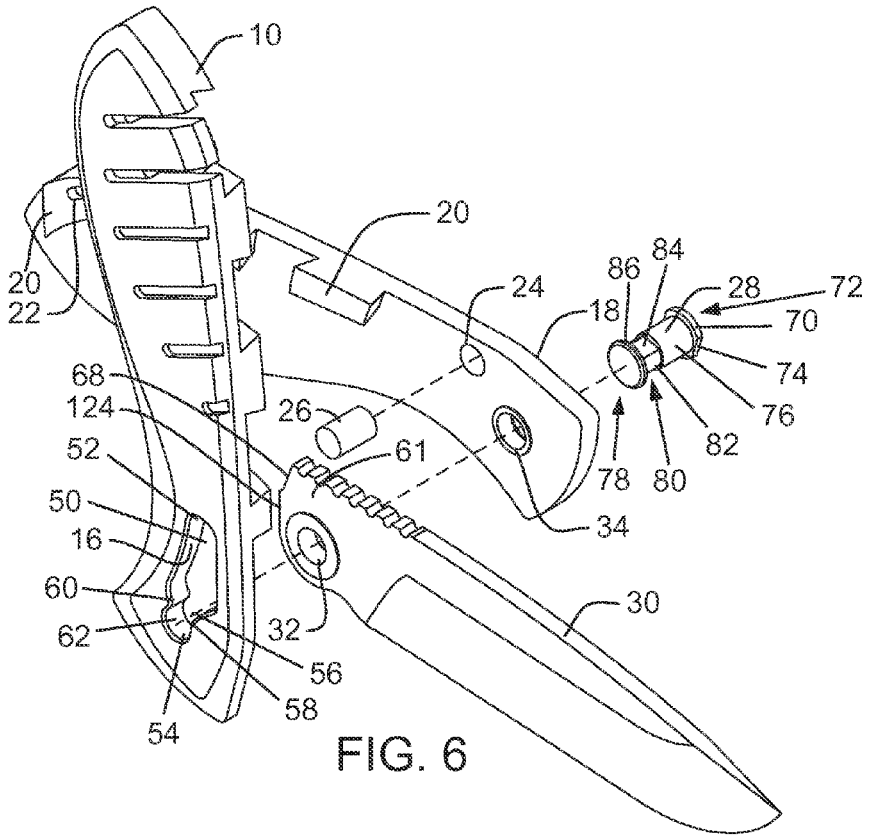
Figure 7:
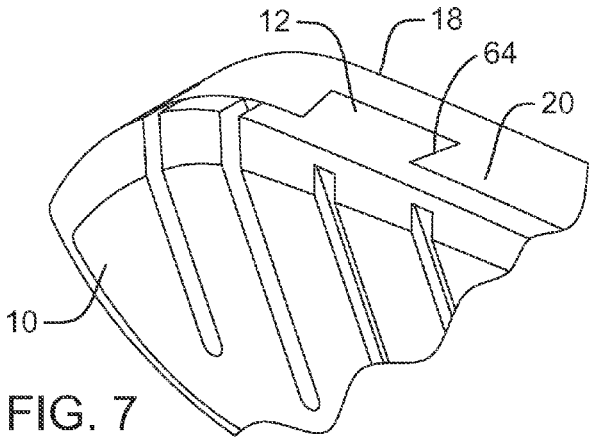
FIG. 7 is a perspective and fragmentary view of the butt end of the knife shown in FIG. 1, illustrating the dovetail structures that interconnect the two sidewalls in the assembled knife.

The structural features of first sidewall 10 will now be described. Plural dovetails 12 extend along the upper edge or spine of handle 10 and extend inwardly toward the blade-receiving groove 6. As detailed below, the dovetails 12 interconnect with cooperative dovetails 20 on second sidewall 18 when the knife is assembled to thereby secure and stabilize the sidewalls relative to one another. The number and location of the dovetails 12 may be varied from the number and position shown in the drawings. As best illustrated in FIG. 6 (with reference to dovetails 20 on second sidewall 18), the combination of the dovetails 12 and 20 separate the sidewalls to define the blade-receiving groove 6 to allow the blade 30 to be rotated into the stowed position with the blade received in the groove. A locking pin 14 (FIG. 8) is formed adjacent butt end 4 of first sidewall 10 and extends toward the opposite sidewall 18. As detailed below, the locking pin 14 interconnects with a lock pin receiving hole 22 that is cooperatively formed on second sidewall 18.

A pivot pin opening 16 is formed through sidewall 10 near the front end 3 of the sidewall. The structural configuration of opening 16 is important to the functional operation of knife 1, and especially the ability to assemble and disassemble the knife without tools.

Pivot pin opening 16 has a rearward open portion shown generally at 50 that gradually enlarges in size in the direction moving from the rearward end 52 of pivot pin opening 16 toward the forward end 54 of pivot pin opening 16. The widest dimension of pivot pin opening 16 is shown with dimension X in FIG. 2. Moving forward from the location of dimension X, the width of pivot pin opening 16 then decreases at a constricted portion or slot 56 that is defined by narrowed width between opposed inwardly projecting shoulders 58 and 60 that project inwardly into the pivot pin opening 16. The width of slot 56 between the closest points of shoulders 58, 60 is shown as dimension Y in FIG. 5. Continuing forward from slot 56, pivot pin opening 16 enlarges in size to define a cylindrical pivot pin bore 62 at the forward end 54 of the pivot pin opening 16. The diameter of cylindrical pivot pin bore 62 is greater than dimension Y but less than the dimension X and less than the diameter of flange 86 on the end of the pivot pin 28, which as detailed below helps attach the sidewall 10 to the pivot pin.

Second sidewall 18 has substantially the same outer peripheral shape as first sidewall 10 and includes plural dovetails 20 that extend along the upper spine of the sidewall and which extend inwardly toward the blade-receiving groove 6. The dovetails 20 of sidewall 18 are, in the assembled knife 1, laterally offset from the dovetails 12 of sidewall 10 so that the dovetails of sidewall 10 interconnect with the dovetails 20 of second sidewall 18 when the knife is assembled. The interconnection of the dovetails 12 and 20 provides a very secure and stable connection between the sidewalls 10 and 18 to define a very stable handle 2, yet as detailed below, allows the sidewalls (and the knife 1) to be easily assembled and disassembled.

It will be appreciated that the dovetails 12 and 20 have cooperative angular and mating walls that abut at joints 64 (see, e.g., FIG. 7) that provide secure interconnection between the sidewalls 10 and 18 when the sidewalls are interconnected.

Figure 2:
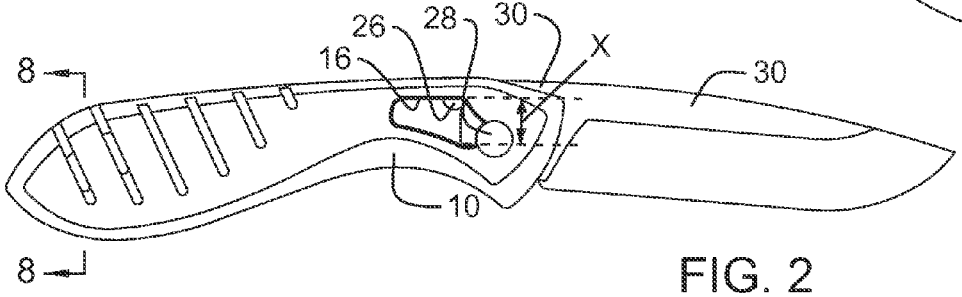
FIG. 2 is a side elevation view of the knife shown in FIG. 1.
Figure 3:
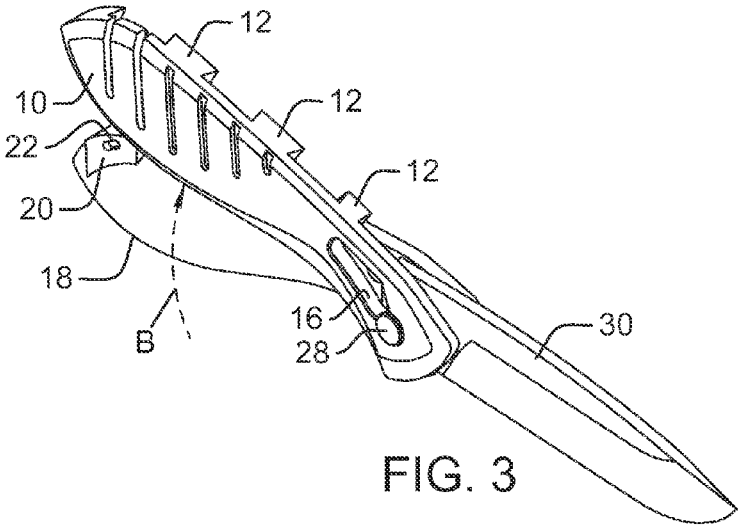
FIGS. 3 through 6 are a series of illustrations showing disassembly and/or disassembly of the knife illustrated in FIG. 1 in sequential steps. Specifically.
Figure 8:
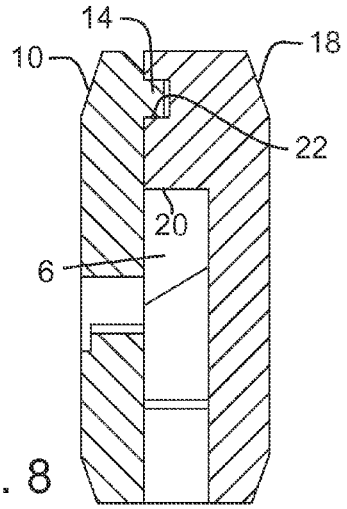
FIG. 8 is a sectional view taken along the line 8-8 of FIG. 2.

Continuing with the description of second sidewall 18, and with reference to FIG. 8, a lock pin receiving hole 22 is formed near the butt end 4 and is cooperatively located on the interior-facing surface of sidewall 18 so that in the assembled knife 1, locking pin 14 on first sidewall 10 is received in lock pin receiving hole 22 to further secure the sidewalls 10 and 18. A blind bore 24 is formed in the interior surface of sidewall 18 and is sized to receive a blade stop pin 26 therein. The blade stop pin 26 extends across blade-receiving groove 6 in the assembled knife and functions to stop rotation of blade 30 in its open position. More specifically, when the blade 30 is in the fully open position as shown in FIGS. 1 and 2, a shoulder 68 on the tang portion 61 of blade 30 abuts the blade stop pin 26 to prevent further rotation of the blade. The blade stop pin 26 has a distal end 27 that in the assembled knife 1 abuts and rests in a stop pin seat 112 formed on the interior-facing surface of first sidewall 10 on the upper edge of the pivot pin opening 16 (as illustrated and described below in respect of FIGS. 9 through 12). A pivot pin bore 34 is formed in second sidewall 18 adjacent forward end 3.

Blade 30 is best described with reference to FIG. 6. The blade is conventional and includes a pivot bore 32 through tang portion 61 and through which blade pivot pin 28 extends. As noted above, a shoulder 68 is formed on the tang portion 61 in a position to engage the blade stop pin 26 when the blade is in the open position.

With continuing reference to FIG. 6, blade pivot pin 28 defines the pin that secures the blade 30 to the handle 2 and around which blade 30 pivots as the blade is moved from closed to open and vice versa. The blade pivot pin 28 has a flange 70 at a proximate end 72 of the pin and the flange has flattened wall portions 74. Adjacent flange 70, the blade pivot pin defines a cylindrical pin portion 76. Immediately adjacent cylindrical pin portion 76 and moving in the direction toward distal end 78, the pivot pin 28 defines a locking portion 80. Locking portion 80 is defined by opposed cylindrical portions 82 that alternate around the circumference of the pin with opposed flattened faces 84 that are adjacent the cylindrical portions 82 and which define substantially parallel planar surfaces—in the perspective view of FIG. 6 only the cylindrical portion 82 and flattened portion 84 on the near side of the pin 28 are shown. The flattened faces 84 are oriented such the plane of the faces are rotated about 90 degrees relative to the plane of the flattened wall portions 74 of flange 70. An outer flange 86 is formed on the distal end 78 of the blade pivot pin 28.

The diameter of the outer flange 86 is less than the diameter of the pivot pin bore 34 in second sidewall 18, and less than the diameter of the pivot bore 32 through blade 30. As such, the distal end 78 pivot pin 28 may be inserted through the pivot pin bore 34 in second sidewall 18, and through the pivot bore 32 through blade 30. The diameter of flange 86 is likewise smaller than the width X of pivot pin opening 16. On the other hand, the diameter of flange 70 at proximate end 72 of pivot pin 28 is greater than the diameter of pivot pin bore 34 in the second sidewall 18. The width of pivot pin 28 between the flattened faces 84 is less than the width Y between shoulders 58 and 60 of pivot pin opening 16 of first sidewall 10. And the width of pivot pin 28 between the cylindrical portions 82—that is, the diameter of the pin at this point since the surfaces are cylindrical—is greater than the width Y between shoulders 58 and 60 of pivot pin opening 16 of first sidewall 10.

When the blade pivot pin 28 is assembled with the first and second sidewalls and blade 30, the pin 28 is first inserted through pivot pin bore 34 in second sidewall 18 until the flange 70 abuts the outer surface of the sidewall around the bore 34. Although not shown in the drawings, the surface of the sidewall around the bore 34 is counter bored to define a recessed seat around the bore that has flattened opposed sides that receive the flattened portions 74 of the flange 70. This prevents rotation of the pivot pin 28 relative to the handle 2, which is important because the anti-rotation functionality provided to pin 28 orients the flattened faces 84 correctly during the assembly and disassembly process. It will be appreciated that the anti-rotation member defined by the flattened portions 74 may be accomplished with other structures such as a single flattened side, a non-circular flange with a cooperatively shaped seat, a keyed slot, etc.

The distal end 78 of pivot pin 28 is then inserted through pivot pin bore 32 of blade 30. The width of blade 30 is substantially equal to the width of the cylindrical pin portion 76 of the pivot pin 28 such that the cylindrical pin portion defines a smooth surface for pivotal rotation of the blade about the pin. With the pivot pin 28 inserted into the pin bore 32 of the blade 30, the blade 30 is moved adjacent to second sidewall 18 such that the blade abuts the interior surface of the sidewall. In this position, the locking portion 80 and flange 86 extend through the blade so that first sidewall 10 may be assembled with the blade and second sidewall.

Figure 5:
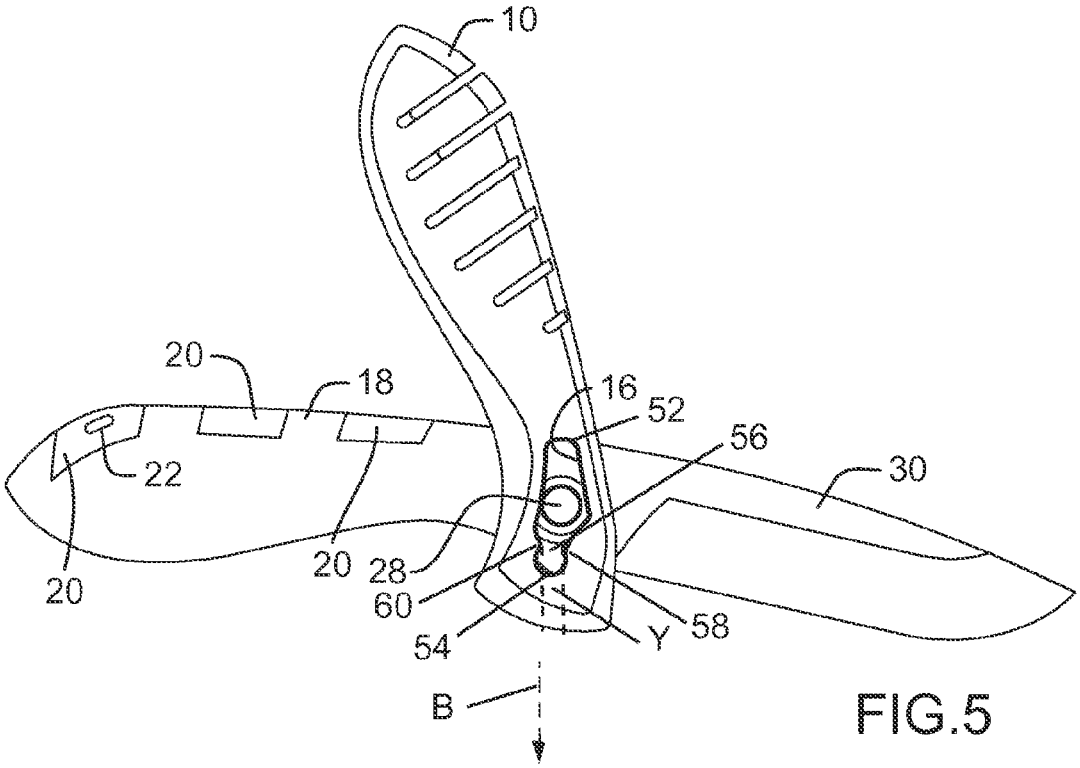

With reference now to the position of the knife components as shown in FIG. 5, first sidewall 10 is rotated about 90 degrees along its longitudinal axis relative to the longitudinal axis defined by second sidewall 20 and blade 30, which is in the open blade position. The first sidewall 10 is then longitudinally offset relative to sidewall 18 so that pivot pin opening 16 is aligned relative to pivot pin 28 such that the widest portion of the pivot pin opening 16—that is, the part of pivot pin opening 16 at width X, overlies the distal end 78 of the pivot pin 28. The first sidewall is then inserted onto the pivot pin 28, with the pin extending through the pivot pin opening 16. Because the width X of pivot pin opening 16 is greater than the diameter of flange 86, the flange moves through the pivot pin opening 16. As noted, the width of locking portion 80 of the pivot pin between the flattened faces 84 is less than width Y of slot 56 that is between shoulders 58 and 60, and the diameter of the pivot pin 28 between the cylindrical portions 82 is greater than the width Y. As also noted, the axial rotational position of pivot pin 28 is fixed when the pin is fully inserted into the second sidewall 18 by virtue of the flattened portions 74 being received in the counter bored and cooperatively shaped seat around the bore 34 in second sidewall 18. As such, the flattened faces 84 of locking portion 80 are oriented such that the first sidewall 10 may be moved relative to the pin 28 such that the flattened faces 84 of the pin slide through the slot 56 when sidewall 10 is oriented relative to sidewall 18 as shown in FIG. 5—the slot 56 thus defines a passageway between the open portion 50 rearward of shoulders 58 and 60 and cylindrical pivot pin bore 62 through which pin 28 may be slid. Said another way, in this relative position of the sidewalls, the flattened faces 84 of pin 28 align with the slot 56. Movement of the first sidewall 10 in the direction opposite that of arrow B in FIG. 5 causes pin 28 to slide through the passageway defined by slot 56. That is, the sidewall 10 is pushed upwardly (in the view of FIG. 5) so that the flattened faces 84 allow the locking portion 80 to slide through the slot 56. When the locking portion 80 is slid completely through slot 56, the locking portion of the pin 28 is received in the cylindrical pivot pin bore 62 at the forward end 54 of the pivot pin opening 16.

The diameter of flange 86 is greater than the diameter of cylindrical pivot pin bore 62 and as such, the flange extends over the outer surface of the sidewall 10 (seen for instance in FIG. 1) during this assembly process.

Figure 4:
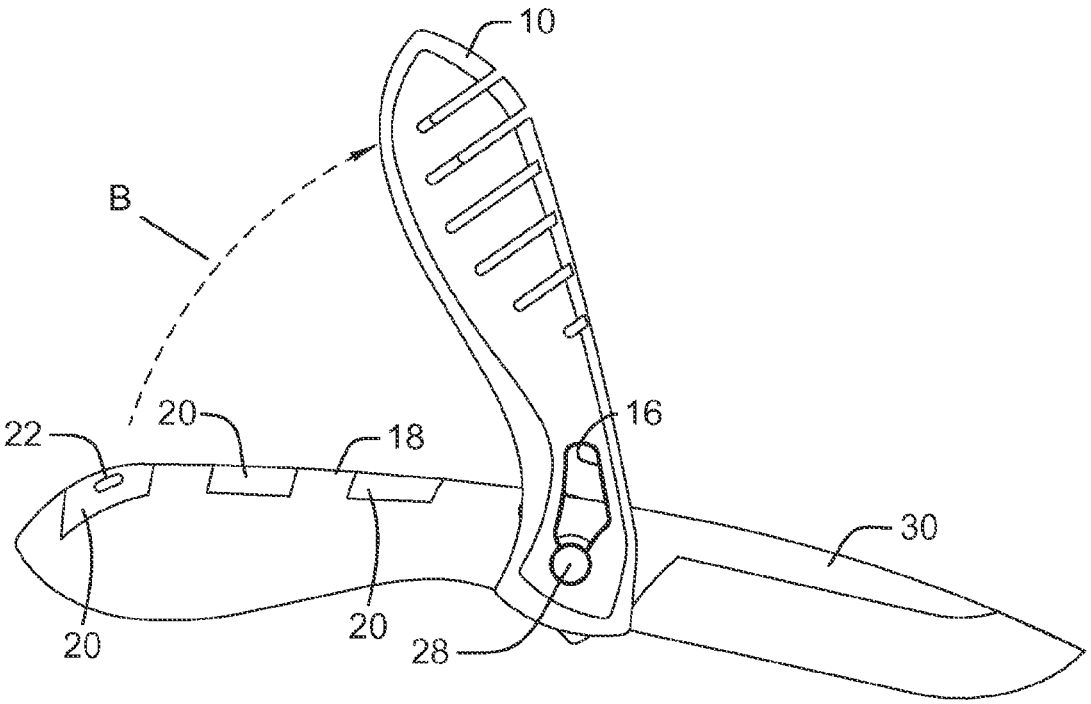

At this point, sidewall 10 may be rotated relative to sidewall 18 in the direction opposite of that shown with arrow A in FIG. 4, (that is, sidewall 10 is rotated in the counterclockwise direction in the view of FIG. 4)—the sidewall 10 is rotating around locking portion 80 of pivot pin 28 with the locking portion 80 resident in cylindrical pivot bore 62. As the sidewall 10 rotates approximately 30 degrees relative to the sidewall 18, the blade stop pin 26 is inserted into bore 24 (through pivot pin opening 16, which at that degree of rotation is aligned with and open to blind bore 24). When the stop pin is inserted the distal end 27 is located within the pivot pin opening 16. As the sidewall 10 is rotated relative to the sidewall 18, the flattened faces 84 of pin 28 become misaligned with the slot 56 (pin 28 cannot axially rotate for the reasons explained above). Because the diameter of the locking portion 80 between the cylindrical portions 82 of the pin is greater than the width Y of slot 56, once the sidewall is rotated enough that the flattened faces 84 are no longer aligned with slot 56, the first sidewall cannot be separated from the pin 28. Stated another way, when the flattened faces 84 are misaligned with the slot 56, the pin 28 is retained in the cylindrical pivot pin bore 62 and cannot be removed therefrom.

Movement of the first sidewall 10 is continued in its counterclockwise rotation relative to the second sidewall 18 until the dovetails 12 on first sidewall 10 mate with and interlock the dovetails 20 on second sidewall 18. When the first and second sidewalls are fully aligned, the locking pin 14 on first sidewall 10 is received into the lock pin receiving hole 22 of second sidewall 18 and the distal end 27 of stop pin 26 is received in the stop pin seat 112 formed in the upper margin of the pivot pin opening 16. See FIGS. 8 and 9. When the pin 14 is received in receiving hole 22 the two sidewalls are locked together by the combination of the interlocked dovetails and the lock defined by the pin 14 and receiving hole 22, and the two sidewalls cannot be unintentionally disconnected. The engagement of lock pin 14 in receiving hole 22 thus prevents further relative rotation of sidewall 10 and sidewall 18. The blade 30 is freely rotatable between closed and open positions. The stop pin 26 further adds to the stability of the knife components when the knife is assembled since one end of the pin is secured in blind bore 24 and the distal end 27 is firmly received in the semi-cylindrical seat in the sidewall 10. This engagement, too, prevents further relative rotation of sidewall 10 in the counterclockwise direction in FIG. 1.

Disassembly of knife 1 is essentially the reverse of the assembly process described above. Thus, first sidewall 10 is rotated relative to sidewall 18 to disconnect the interlocked dovetails 12 and 20 (that is, clockwise in the drawing figures as shown with arrows B). It will be appreciated that a certain amount of force must be applied to the first sidewall 10 to disengage the lock defined by pin 14 extending into receiving hole 22. Alternately, the width of the blade-receiving groove may be manually and slightly expanded at the butt end 4 of the handle 2 while rotating the first sidewall 10 to disengage the pin 14 from the receiving hole 22. (This separation of the two sidewalls to disengage the pin 14 from the hole 22 is explained in detail below in respect of the embodiment of a knife 100 shown in FIGS. 9 through 12, wherein the locking functionality between the sidewalls may be accomplished by providing a frame-spring.) With continued description of knife 1, when the first sidewall 10 is rotated relative to the second sidewall 18 by about 30 degrees, the stop pin 26 is open to the pivot pin opening 16 and so the stop pin may be removed through the opening. With the stop pin removed, disassembly may be continued.

When sidewall 10 reaches the position shown in FIG. 5 relative to sidewall 18, the flattened portions 84 of locking portion 80 re-align with slot 56 so that the pivot pin 28 may be slid through the slot 56 by moving sidewall 10 in the direction opposite of the arrow B in FIG. 5. From the foregoing it will be apparent that the pivot pin opening 16 serves multiple functions, namely, it is large enough that flange 86 on the distal end of pivot pin 28 may be inserted through the opening, and it allows removal of the stop pin through the opening.

It will be appreciated that knife 1 of the present invention may, if desired, include optional components such as a blade lock, for instance, a frame lock, and may include spring-loaded detent balls that function to retain the blade in the closed position.

It will further be appreciated that the knife 1 according to the invention as described above and as shown in the drawings incorporates:

a) a self-locking pivot defined by pivot pin 28 that firmly but rotatably attaches the blade to the handle;

b) a sidewall-to-sidewall interlocking component defined by the engaged dovetails 12 and 20 that interlock the two sidewalls together; and c) a sidewall-to-sidewall lock defined by locking pin 14 and receiving hole 22 that locks the two sidewalls together to prevent them from becoming separated at the dovetails.

Those of skill in the art will understand that certain modifications fall within the ordinary skill level and may be substituted for structures described herein without departing from the scope of the invention. To name a few example, the interlocking dovetails described above and shown in the drawings may be modified in shape, and traditional fasteners could be used to interlock the two sidewalls while retaining the self-locking pivot defined by pivot pin 28. And of course, the invention is not limited to use with folding knives—it may be applied to any folding tool such as a multi-tool that has one or more implements that are rotatably attached to a handle and movable between open and closed positions.

Reference is now made to the series of drawings of FIGS. 9 through 12, which show an alternative embodiment of a knife 100 according to the present invention. Structural features shown in FIGS. 9 through 12 that are the same as or analogous to the structural features of FIGS. 1 through 8 are given the same reference numbers. Knife 100 incorporates the three elements described above that are found in knife 1, namely, d) a self-locking pivot defined by pivot pin 28 that firmly but rotatably attaches the blade to the handle;

e) a sidewall-to-sidewall interlocking component defined by the engaged dovetails 12 and 20 that interlock the two sidewalls together; and f) a sidewall-to-sidewall lock defined by locking pin 14 and receiving hole 22 that locks the two sidewalls together to prevent them from becoming separated at the dovetails.

However, the knife 100 modifies some of those structures slightly and adds other features, as detailed below. Initially, it should be clear that in the knife 100 of FIGS. 9 through 12, the lock pin 14 is carried on sidewall 18 and the lock pin receiving hole 22 is formed in sidewall 10. This is in contrast to the embodiment of FIG. 1 in which the lock pin 14 is carried on sidewall 10 and the lock pin receiving hold 22 is formed in sidewall 18.

Figure 11:
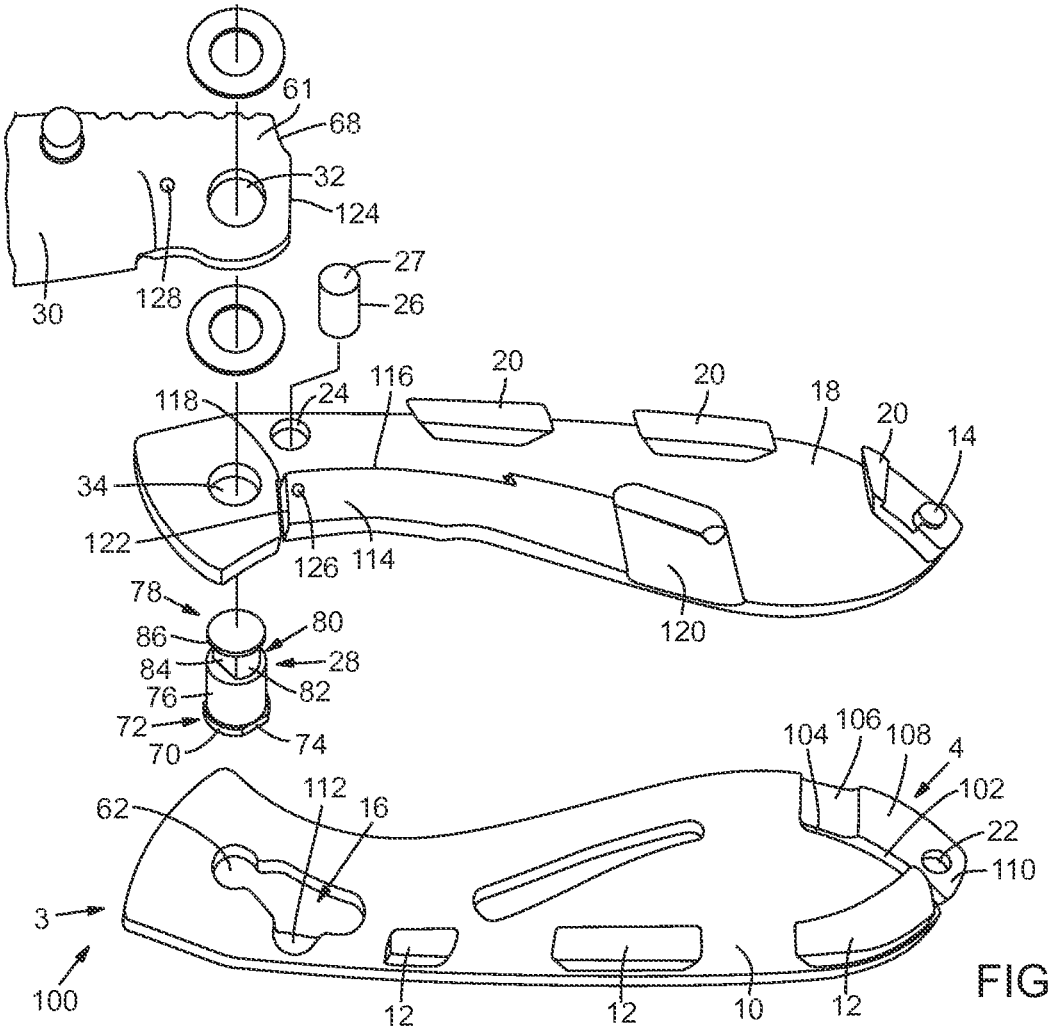
Figure 12:
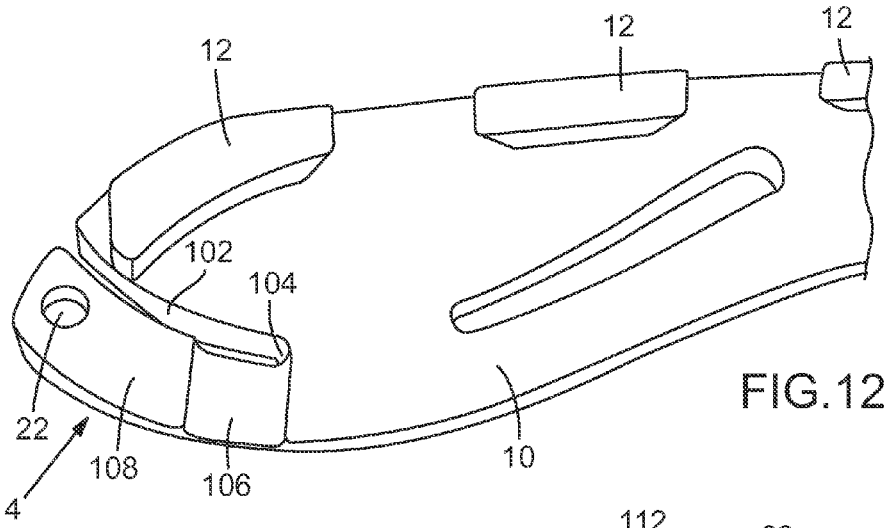

As best viewed in FIG. 11, sidewall 10 of knife 100 includes a relief cut 102 near the butt end 4 of the sidewall and the thickness of the sidewall material is reduced at the inner end 104 of the relief cut at a thinned portion 106. The relief cut 102 combined with the thinned portion 106 of sidewall 10 defines a spring arm 108 that is normally biased inwardly toward the blade-receiving groove in the assembled knife. The lock pin receiving hole 22 is formed near the outer end 110 of the spring arm 108. The opposite sidewall 18 includes the lock pin 14 (as a pin that is press fit into a receiving bore as opposed to a monolithically formed pin) in a cooperative location near the butt of the sidewall so that when the two sidewalls 10 and 18 are assembled, the lock pin 14 snaps into the lock pin receiving hole 22 in the inwardly-biased spring arm 108.

Figure 9:
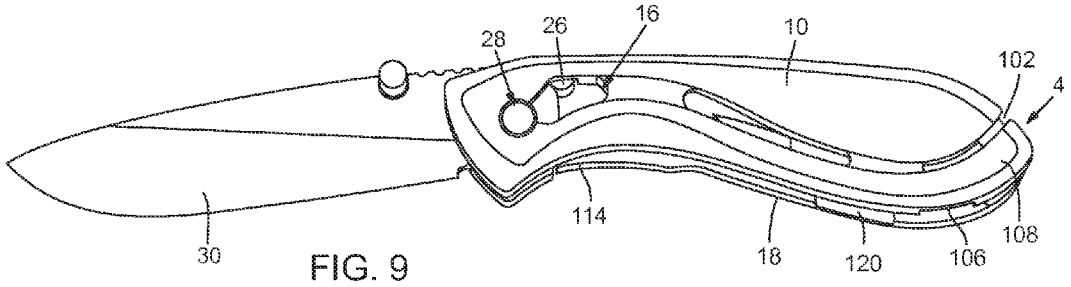
FIGS. 9 through 12 are views of a second illustrated embodiment of a folding knife incorporating the present invention, specifically.

As also visible in FIG. 11, a semi-cylindrical stop pin seat 112 is formed in the upper and interior-facing edge of pivot pin opening 16 (upper referring to the assembled knife as shown in FIG. 9). The stop pin seat 112 is located so that in the assembled knife 100, the distal end 27 of stop pin 26 resides in the seat but does not interfere with relative rotation of the sidewalls to assemble and disassemble the components.

Knife 100 further includes a frame lock mechanism defined by a spring arm 114 formed along the lower edge of the second sidewall 18 by a longitudinal cut 116 and a transverse cut 118. Together, the longitudinal cut 116 and transverse cut 118 form the longitudinal spring arm 114, which is biased inwardly toward the blade-receiving groove (when assembled). Adjacent the rearward end of the longitudinal cut 116 is a thinned sidewall area 120 that allows the spring arm 114 to be biased inwardly and outwardly in respect of the blade-receiving groove. The forward-facing edge 122 of spring arm 114 defines a locking surface that engages a cooperative locking surface 124 at the back edge of the tang portion 61 of blade 30. A spring-loaded detent ball 126 is carried in the spring arm 114 and interacts with a detent bore 128 in tang portion 61 of blade 30. The detent ball 126 engages the detent bore 128 when the blade 30 is in the closed position to retain the blade in that position against unintended opening.

Figure 10:
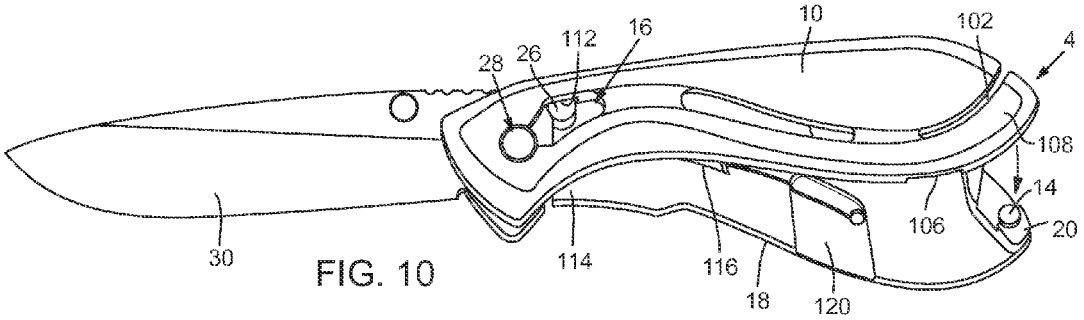

The butt end 4 of sidewall 10 of knife 100 is shown in greater detail in FIG. 10 to illustrate the relief cut 102 and the thinned portion 106 that together define the spring arm 108 into which the lock pin receiving hole 22 is formed.

Figure 13:
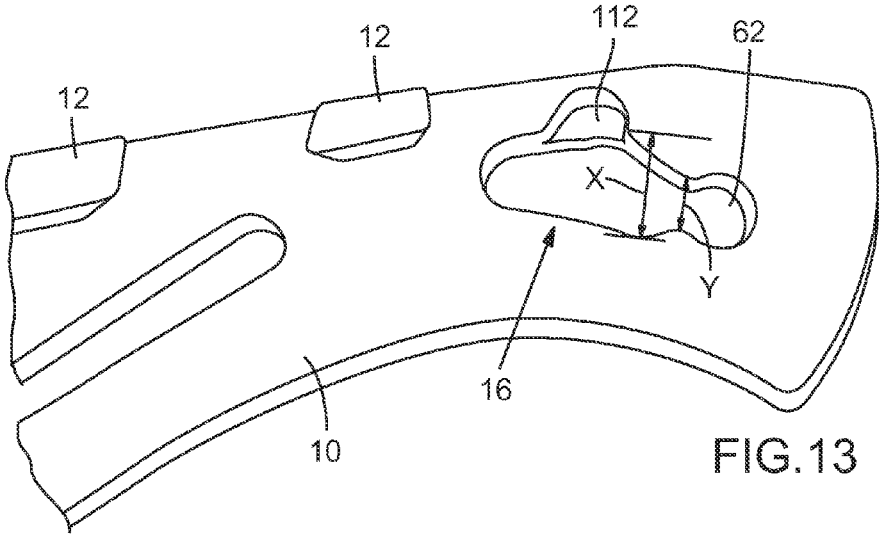
FIG. 13 is a perspective view of the interior surface of the forward end of one sidewall of the knife shown in FIG. 9.
Figure 14:
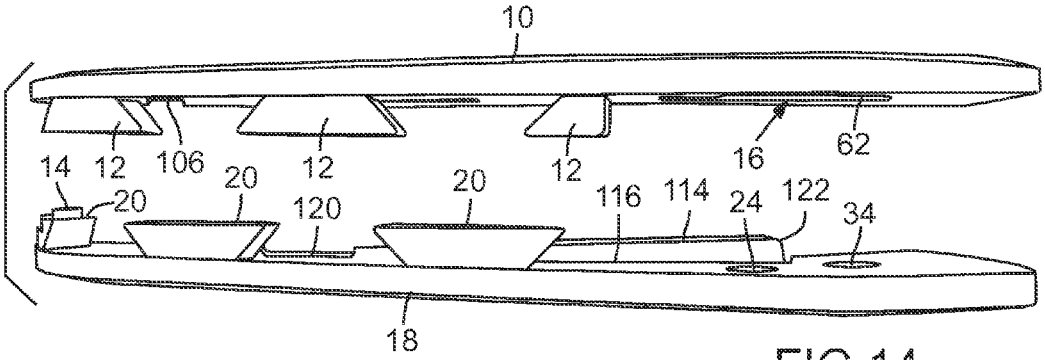
FIG. 14 is a perspective and top view of the two sidewalls of the knife shown in FIG. 9 with the blade removed and the sidewalls oriented adjacent one another to illustrate the dovetails and lock that interconnect the sidewalls.

FIG. 13 shows in greater detail the interior-facing surface of sidewall 10 near the forward end 3 and shows in detail the widths X and Y and the stop pin receiving seat 112. And in FIG. 12 the sidewalls 10 and 18 are juxtaposed next to one another to illustrate the dovetails 12 and 20.

The knife 100 of FIGS. 9 through 12 is assembled and disassembled in the same manner as described above with respect to the embodiment of FIGS. 1 through 8. Those of skill in the art will recognize that because the leaf spring defined by spring arm 108 is biased toward the blade-receiving slot (and thus the opposite sidewall, the lock pin 14 snaps into the lock pin receiving hole 22 when the knife is assembled. And the spring 108 may be manually biased away from the blade-receiving groove by the user to disengage the pin 14 from the slot 22 to allow relative rotation of the sidewalls 10 and 18 to facilitate disassembly. Cut lines in the inside of the sidewall to facilitate an easier grip for the user may also be used.

Those of skill in the art will recognize that certain structural features described above and shown in the drawings serve specific functions that may be replicated with equivalent structures. For example, the dovetails 12 and 20 function as sidewall interconnecting members that engage and stabilize the sidewalls. The same function could be accomplished with, for example, T-shaped members on one sidewall that engage a cooperatively shaped slot on the other sidewall; or a rounded member that engages a rounded receptacle, to name a few.

While the present invention has been described in terms of a preferred embodiment, it will be appreciated by one of ordinary skill that the spirit and scope of the invention is not limited to those embodiments, but extend to the various modifications and equivalents as defined in the appended claims.

The invention claimed is:

1. A folding knife, comprising:

a handle defined by first and second laterally spaced apart sidewalls defining a blade receiving groove therebetween, said first sidewall having a pivot shaft bore and said second sidewall having a pivot shaft opening that defines a first opening with a first opening size and a second opening with a second opening size that is less than the first opening size, and a passageway communicating between the first and second openings, said passageway having a width that is less than the second opening size;

a blade rotationally connected between the sidewalls with a pivot shaft extending through the pivot shaft bore in the first sidewall, a pivot shaft bore in a tang of the blade, and through the second opening in the second sidewall, said pivot shaft having a locking portion defined by opposed flattened surfaces that define a width therebetween that is less than the width of the passageway and opposed second surfaces that define a width therebetween that is greater than the width of the passageway.

2. The folding knife according to claim 1 further comprising first and second sidewall interconnecting members that connect said first and second sidewalls together.

3. The folding knife according to claim 2 further comprising a handle lock defined by a pin on one of said sidewalls and a pin receptacle on the other of said sidewalls.

* * * * *